US010774775B2

(12) United States Patent
Berkemeier et al.

(10) Patent No.: US 10,774,775 B2
(45) Date of Patent: Sep. 15, 2020

(54) DIRECT-INJECTION, SUPERCHARGED INTERNAL COMBUSTION ENGINE WITH HIGH-PRESSURE FUEL PUMP, AND METHOD FOR OPERATING AN INTERNAL COMBUSTION ENGINE OF SAID TYPE

(71) Applicant: Ford Global Technologies, LLC, Dearborn, MI (US)

(72) Inventors: Oliver Berkemeier, Bergisch Gladbach (DE); Jan Mehring, Cologne (DE); Klemens Grieser, Langenfeld (DE)

(73) Assignee: Ford Global Technologies, LLC, Dearborn, MI (US)

( * ) Notice: Subject to any disclaimer, the term of this patent is extended or adjusted under 35 U.S.C. 154(b) by 448 days.

(21) Appl. No.: 15/640,116

(22) Filed: Jun. 30, 2017

(65) Prior Publication Data

US 2018/0010543 A1 Jan. 11, 2018

(30) Foreign Application Priority Data

Jul. 5, 2016 (DE) ..... 10 2016 212 233

(51) Int. Cl.
*F02D 41/38* (2006.01)
*F04B 53/16* (2006.01)
(Continued)

(52) U.S. Cl.
CPC ..... *F02D 41/3845* (2013.01); *F02M 59/025* (2013.01); *F02M 59/24* (2013.01);
(Continued)

(58) Field of Classification Search
CPC ..... F02D 2041/389; F02D 2200/0602; F02D 2200/0606; F02D 41/3845; F02M 59/025;
(Continued)

(56) References Cited

U.S. PATENT DOCUMENTS 5,327,872 A 7/1994 Morikawa
5,878,718 A * 3/1999 Rembold ..... F02D 33/006 123/198 D (Continued)

FOREIGN PATENT DOCUMENTS

EP 1657429 A1 5/2006
WO 2008149385 A1 12/2008
WO 2014063715 A1 5/2014

*Primary Examiner* — George C Jin
*Assistant Examiner* — Teuta B Holbrook
(74) *Attorney, Agent, or Firm* — Geoffrey Brumbaugh; McCoy Russell LLP

(57) ABSTRACT

A direct-injection, supercharged internal combustion engine having at least one cylinder, in which each cylinder is equipped with a direct injection apparatus, a fuel supply system comprising a high-pressure side and a low-pressure side, and a high-pressure piston pump comprising a piston displaceable in translational fashion between a bottom dead center and a top dead center of a pressure chamber of variable volume. The displaceable piston jointly delimits the pressure chamber with variable volume in such a way that a displacement of the piston causes a change in the volume of the pressure chamber via actuation of least one movable actuation element.

11 Claims, 4 Drawing Sheets

(51) Int. Cl.

| | |
|---|---|
| ***F02M 59/02*** | (2006.01) |
| ***F02M 59/24*** | (2006.01) |
| ***F02M 59/46*** | (2006.01) |
| ***F04B 19/22*** | (2006.01) |
| ***F04B 49/06*** | (2006.01) |
| ***F04B 49/16*** | (2006.01) |

(52) U.S. Cl.
CPC ..... *F02M 59/462* (2013.01); *F02M 59/464* (2013.01); *F04B 19/22* (2013.01); *F04B 49/065* (2013.01); *F04B 49/16* (2013.01); *F04B 53/16* (2013.01); *F02D 2041/389* (2013.01); *F02D 2200/0602* (2013.01); *F02D 2200/0606* (2013.01)

(58) Field of Classification Search
CPC .... F02M 59/24; F02M 59/462; F02M 59/464; F04B 19/22; F04B 49/065; F04B 49/16; F04B 53/16
USPC ..... 417/437, 415, 510, 511; 123/445, 456, 123/461
See application file for complete search history.

(56) References Cited

U.S. PATENT DOCUMENTS 5,899,195 A * 5/1999 Firey ..... F02B 17/00 123/295
6,295,965 B1 * 10/2001 Firey ..... F02B 17/005 123/250
6,439,863 B1 * 8/2002 McKay ..... F02M 37/20 137/199
6,447,273 B1 9/2002 Nishimura et al.
6,651,630 B2 11/2003 Hiraku et al.
6,772,734 B2 * 8/2004 Schueler ..... F02M 59/34 123/446
6,889,656 B1 * 5/2005 Rembold ..... F02D 41/062 123/446
9,016,263 B2 4/2015 Zeng et al.
2001/0052339 A1 * 12/2001 Halleron ..... F02B 17/005 123/519
2002/0033167 A1 * 3/2002 Hiraku ..... F02D 41/3845 123/456
2007/0006851 A1 * 1/2007 Okamura ..... F02D 41/40 123/478
2008/0072880 A1 * 3/2008 Wachtendorf ..... F02D 41/2464 123/495
2011/0106393 A1 5/2011 Pursifull
2011/0288745 A1 * 11/2011 Warner ..... F02D 41/0027 701/103
2014/0064989 A1 3/2014 Sato et al.
2014/0121943 A1 * 5/2014 Lee ..... F02D 41/042 701/103
2014/0209068 A1 * 7/2014 Hillenbrand ..... F02D 41/0097 123/511
2015/0122217 A1 * 5/2015 Bullmer ..... F02M 53/02 123/295
2016/0146146 A1 * 5/2016 Pursifull ..... F02D 41/26 701/104
2016/0153384 A1 * 6/2016 Ulrey ..... F02D 41/3082 123/464
2016/0153385 A1 * 6/2016 Pursifull ..... F02M 59/102 123/299
2016/0160790 A1 * 6/2016 Pursifull ..... F02D 41/3082 123/294
2016/0377017 A1 * 12/2016 Basmaji ..... F02D 41/3845 701/103
2017/0107931 A1 * 4/2017 Anetsberger ..... F02M 59/022

* cited by examiner

DIRECT-INJECTION, SUPERCHARGED INTERNAL COMBUSTION ENGINE WITH HIGH-PRESSURE FUEL PUMP, AND METHOD FOR OPERATING AN INTERNAL COMBUSTION ENGINE OF SAID TYPE

CROSS REFERENCE TO RELATED APPLICATION

The present application claims priority to German Patent Application No. 102016212233.9, filed on Jul. 5, 2016, the entire contents of which are hereby incorporated by reference for all purposes.

FIELD

The invention relates to a direct-injection, supercharged internal combustion engine having at least one cylinder, in which each cylinder is equipped with an injection apparatus for the direct injection of fuel into the cylinder.

For the purposes of supplying fuel to the at least one cylinder, a fuel supply system is provided which comprises a high-pressure side and a low-pressure side, and the fuel supply system is equipped with at least one high-pressure piston pump which comprises a piston displaceable in translational fashion between a bottom dead center and a top dead center and which comprises a pressure chamber of variable volume, an inlet side and an outlet side of the high-pressure piston pump being connectable to the pressure chamber, and the displaceable piston jointly delimiting the pressure chamber with variable volume in such a way that a displacement of the piston causes a change in the volume $V_{chamber}$ of the pressure chamber.

BACKGROUND/SUMMARY

In the development of internal combustion engines, it is constantly sought to minimize fuel consumption and reduce pollutant emissions. Fuel consumption is a problem, especially in Otto-cycle engines. The reason for this lies in the principle of the working process of the traditional Otto-cycle engine which is operated with a homogeneous fuel-air mixture, in which the desired power is set by varying the charge of the combustion chamber, that is to say by means of quantity regulation. By adjusting a throttle flap which is provided in the intake tract, the pressure of the inducted air downstream of the throttle flap can be reduced to a greater or lesser extent. For a constant combustion chamber volume, it is possible in this way for the air mass, that is to say the quantity, to be set by means of the pressure of the inducted air. This also explains why quantity regulation has proven to be disadvantageous specifically in part-load operation, because low loads require a high degree of throttling and a large pressure reduction in the intake system, as a result of which the charge exchange losses increase with decreasing load and increasing throttling.

One approach for dethrottling the Otto-cycle working process is to utilize direct fuel injection. The injection of the fuel directly into the combustion chamber of the cylinder is considered to be a suitable measure for noticeably reducing fuel consumption even in Otto-cycle engines. The dethrottling of the internal combustion engine is realized by virtue of quality regulation being used within certain limits. With the direct injection of the fuel into the combustion chamber, it is possible in particular to realize a stratified combustion chamber charge, which can contribute significantly to the dethrottling of the Otto-cycle working process because the internal combustion engine can be leaned to a great extent by means of the stratified charge operation, which offers thermodynamic advantages in particular in part-load operation, that is to say in the lower and middle load range, when only small amounts of fuel are to be injected.

Direct injection is characterized by an inhomogeneous combustion chamber charge which is not characterized by a uniform air ratio but which generally has both lean ($\lambda>1$) mixture parts and rich ($\lambda<1$) mixture parts. The inhomogeneity of the fuel-air mixture is also a reason why the particle emissions known from the diesel engine process are likewise of relevance in the case of the direct-injection Otto-cycle engine, whereas said emissions are of almost no significance in the case of the traditional Otto-cycle engine.

There is relatively little time available for the injection of the fuel, for the mixture preparation in the combustion chamber, specifically the mixing of air and fuel and the preparation of the fuel within the context of preliminary reactions including evaporation, and for the ignition of the prepared mixture.

The resulting demands placed on the mixture formation relate not only to the direct-injection Otto-cycle engine but basically to any direct-injection internal combustion engine, and thus also to direct-injection diesel engines. The internal combustion engine to which the present invention relates is very generally a direct-injection internal combustion engine. For the direct injection, a fuel supply system is required which is capable of building up, in the fuel to be injected, the high pressure required for the direct injection. Therefore, the fuel supply system of a direct-injection internal combustion engine according to the prior art is equipped with at least one high-pressure pump. As a high-pressure pump, use is generally made of a piston pump in which a piston which is displaceable in translational fashion between a bottom dead center and a top dead center oscillates during the operation of the pump for the purposes of fuel delivery, in order to draw in fuel from the low-pressure side during a suction stroke and to pump, that is to say deliver, said fuel to the high-pressure side during a delivery stroke. For the regulation of the fuel volume flow, a valve unit is commonly provided by means of which the high-pressure pump is supplied with fuel from a fuel reservoir.

Depending on the conditions presently prevailing in the fuel, in particular the temperature and the pressure, a greater or lesser fraction of the fuel may evaporate, that is to say change from the liquid phase into the gaseous phase, in particular during the suction stroke. This generally leads to a malfunction of the high-pressure pump, because, owing to the gaseous fuel that is present, the pump cannot build up the high pressure required for the direct injection. Rather, the piston, which oscillates during the operation of the pump, compresses the gaseous fuel phase without delivering the demanded fuel quantity.

The delivered fuel quantity does not correspond to the demanded fuel quantity and is generally neither predictable nor reproducible. In some cases, it is even the case that fuel is no longer delivered at all, that is to say the fuel delivery to the cylinders is stopped entirely. In one example, the presence of fuel vapors at the high pressure fuel pump can result in a precipitous drop in direct injection fuel rail pressure, causing the engine to stall.

In addition, if the direct injection fuel rail pressure falls below a minimum desired direct injection pressure, it can result in unpredictable fuel injection masses. The fuel metering error may result in torque errors as well as undesirable exhaust soot emissions.

Against the background of that stated above, it is an object of the present invention to provide a direct-injection, supercharged internal combustion engine where the issues relating to the evaporation of fuel during the course of the fuel delivery can be overcome.

In one example, the issues described above may be overcome by a direct-injection, supercharged internal combustion engine having at least one cylinder, in which each cylinder is equipped with an injection apparatus for the direct injection of fuel into the cylinder, for the purposes of supplying fuel to the at least one cylinder, a fuel supply system is provided which comprises a high-pressure side and a low-pressure side, and the fuel supply system is equipped with at least one high-pressure piston pump which comprises a piston displaceable in translational fashion between a bottom dead center and a top dead center and which comprises a pressure chamber of variable volume, an inlet side and an outlet side of the high-pressure piston pump being connectable to the pressure chamber, and the displaceable piston jointly delimiting the pressure chamber with variable volume in such a way that a displacement of the piston causes a change in the volume $V_{chamber}$ of the pressure chamber, which internal combustion engine is distinguished by the fact that the high-pressure piston pump is equipped with at least one movable actuation element which jointly delimits the pressure chamber such that a movement of the actuation element causes a change in the volume $V_{chamber}$ of the pressure chamber, whereby the high-pressure piston pump is provided with a variable compression ratio $\varepsilon_{pump}$.

In one example, the high-pressure piston pump has a variable compression ratio $\varepsilon_{pump}$. This is realized using at least one movable actuation element which jointly delimits the pressure chamber of the high-pressure piston pump. By movement of the actuation element, the compression volume $V_c$ can be changed, that is to say varied, whereby a variable compression volume $\varepsilon_{pump}$ can be realized.

As used herein, the compression volume $V_c$ is the volume that the pressure chamber has when the piston is at top dead center. The physical feature whereby the movable actuation element jointly delimits the pressure chamber is, in the context of the present invention, to be interpreted to mean that the movable actuation element either directly delimits the pressure chamber, that is to say is itself acted on by fuel, or else indirectly delimits said pressure chamber, that is to say is not itself acted on by fuel. The latter requires the provision of at least one intermediate element, for example a diaphragm, which is arranged between the fuel and the actuation element.

By reducing the size of the compression volume $V_c$, the compression ratio $\varepsilon_{pump}$ can be increased, and the maximum pressure that can be realized by means of the pump can be increased in accordance with demand. In this way, evaporation of fuel can be counteracted, and/or evaporated fuel situated in the pressure chamber can be liquefied again.

This has the advantageous effect that a malfunction of the high-pressure pump can be prevented, and the pump is capable of building up the high pressure required for the direct injection. The delivered fuel quantity consequently corresponds to the demanded fuel quantity, is predictable and reproducible.

In this way, by using a high pressure piston pump having a variable compression ratio piston, issues relating to the evaporation of fuel from the high pressure pump during the course of direct fuel injection can be overcome.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
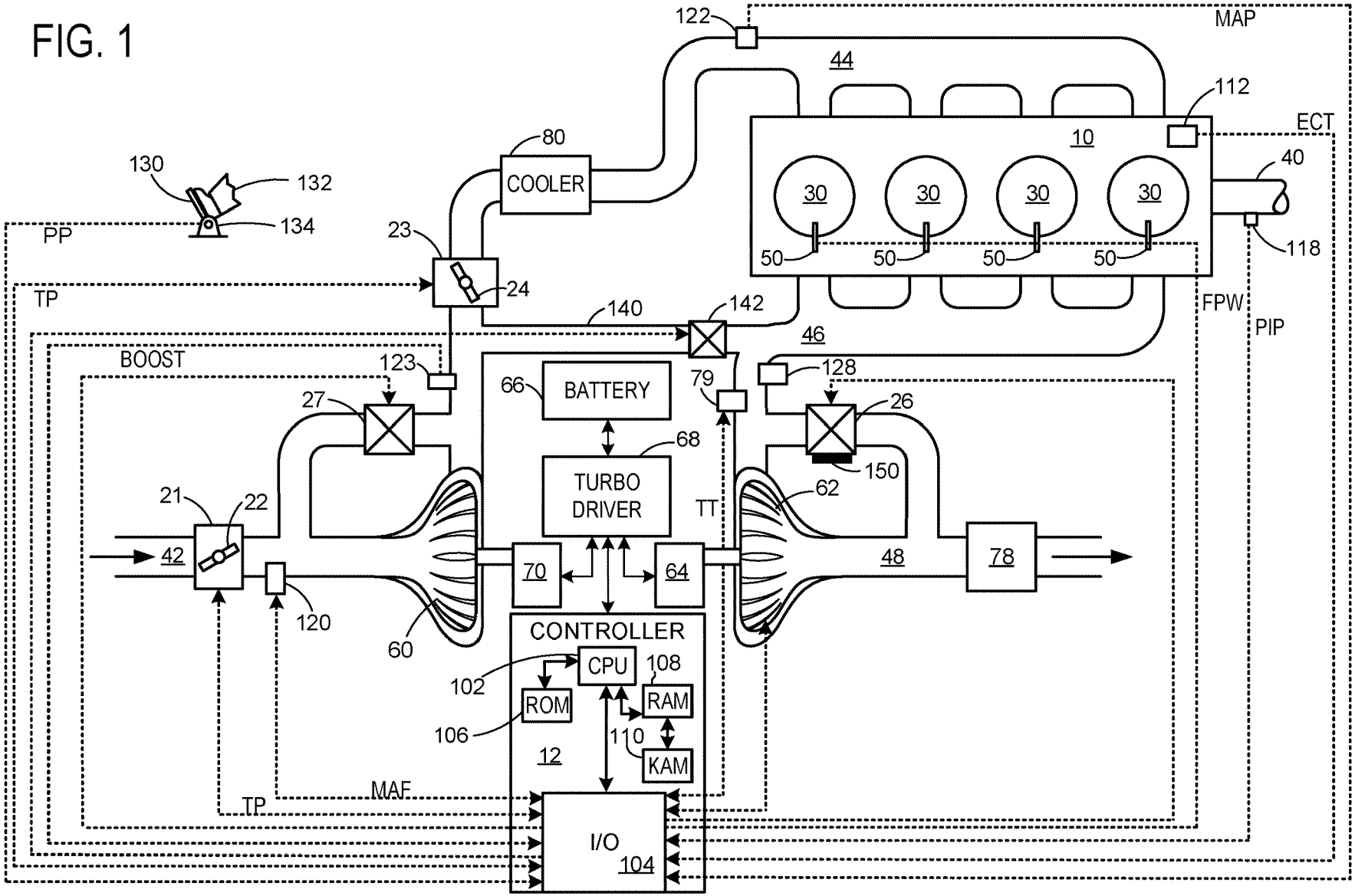
FIG. 1 is a schematic diagram showing an example engine.
Figure 2:
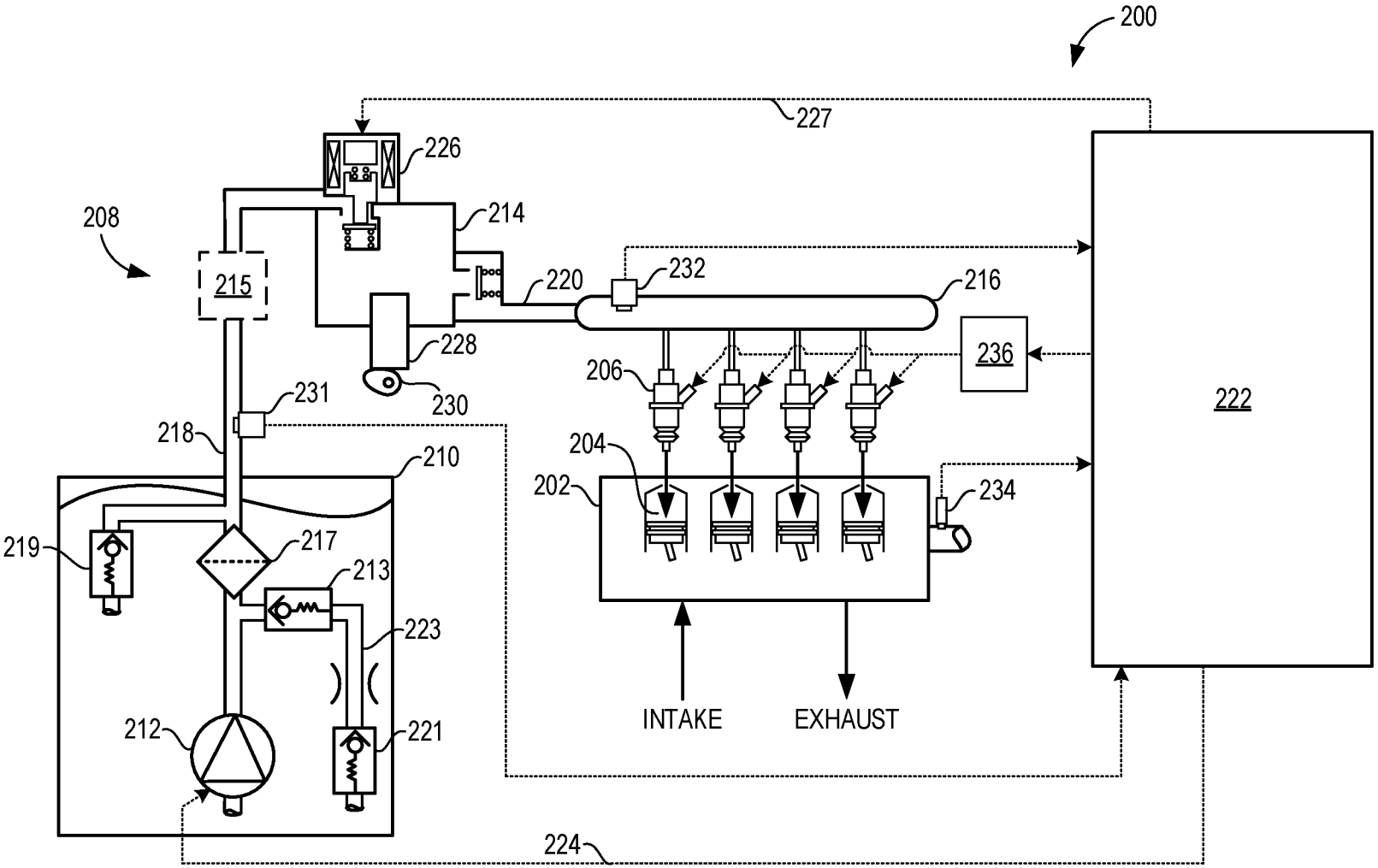
FIG. 2 shows a direct injection engine system.
Figure 3B:
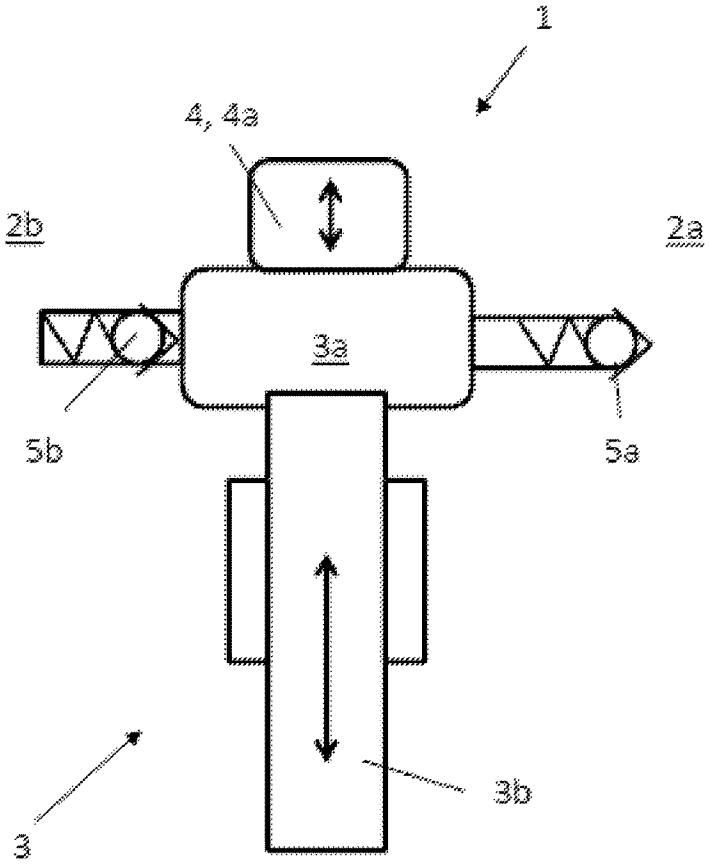
FIG. 3B schematically shows, in a diagrammatic sketch, the fuel supply system of the embodiment illustrated in FIG. 3A with the high-pressure piston pump in a relatively low compression ratio $\varepsilon_{pump,low}<\varepsilon_{pump,high}$.
Figure 3A:
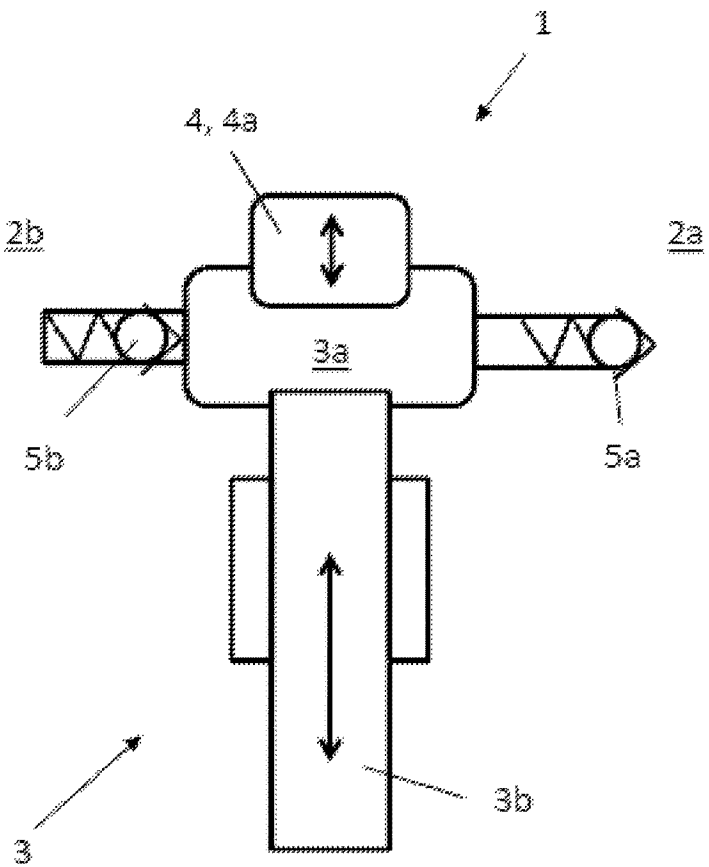
FIG. 3A schematically shows, in a diagrammatic sketch, a fragment of the fuel supply system of a first embodiment of the internal combustion engine with the high-pressure piston pump and a relatively high compression ratio $\varepsilon_{pump,high}$.

Methods and system are provided for an internal combustion engine equipped with a supercharging arrangement, that is to say is boosted, such as the engine system of FIG. 1. The engine may be configured for direct fuel injection and may include a high pressure piston pump, as depicted in FIG. 2. The high pressure fuel pump (HPP) may include a variable compression ratio mechanism that enables the compression ratio of the piston of the HPP to be varied between a higher and a lower compression ratio, as shown at FIGS. 3A-3B. An engine controller may be configured to perform a control routine, such as the example routine of FIG. 4, to vary the compression ratio of the HPP based on engine operating conditions to reduce fuel evaporation and to increase the condensation of fuel vapors into liquid fuel in the fuel pump piston chamber. FIG. 1 is a schematic diagram showing an example engine 10, which may be included in a propulsion system of an automobile. The engine 10 is shown with four cylinders 30. However, other numbers of cylinders may be used in accordance with the current disclosure. Engine 10 may be controlled at least partially by a control system including controller 12, and by input from a vehicle operator 132 via an input device 130. In this example, input device 130 includes an accelerator pedal and a pedal position sensor 134 for generating a proportional pedal position signal PP. Each combustion chamber (e.g., cylinder) 30 of engine 10 may include combustion chamber walls with a piston (not shown) positioned therein. The pistons may be coupled to a crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel to enable a starting operation of engine 10.

Combustion chambers 30 may receive intake air from intake manifold 44 via intake passage 42 and may exhaust combustion gasses via exhaust passage 48. Intake manifold 44 and exhaust manifold 46 can selectively communicate with combustion chamber 30 via respective intake valves and exhaust valves (not shown). In some embodiments, combustion chamber 30 may include two or more intake valves and/or two or more exhaust valves.

Fuel injectors 50 are shown coupled directly to combustion chamber 30 for injecting fuel directly therein in proportion to the pulse width of signal FPW received from controller 12. In this manner, fuel injector 50 provides what is known as direct injection of fuel into combustion chamber 30. The fuel injector may be mounted in the side of the combustion chamber or in the top of the combustion chamber, for example. Fuel may be delivered to fuel injector 50 by a fuel system (not shown) including a fuel tank, a fuel pump, and a fuel rail. An example fuel system that may be employed in conjunction with engine 10 is described below with reference to FIG. 2. In some embodiments, combustion chambers 30 may alternatively, or additionally, include a fuel injector arranged in intake manifold 44 in a configuration that provides what is known as port injection of fuel into the intake port upstream from each combustion chamber 30.

Intake passage 42 may include throttle 21 and 23 having throttle plates 22 and 24, respectively. In this particular example, the position of throttle plates 22 and 24 may be varied by controller 12 via signals provided to an actuator included with throttles 21 and 23. In one example, the actuators may be electric actuators (e.g., electric motors), a configuration that is commonly referred to as electronic throttle control (ETC). In this manner, throttles 21 and 23 may be operated to vary the intake air provided to combustion chamber 30 among other engine cylinders. The position of throttle plates 22 and 24 may be provided to controller 12 by throttle position signal TP. Intake passage 42 may further include a mass air flow sensor 120, a manifold air pressure sensor 122, and a throttle inlet pressure sensor 123 for providing respective signals MAF (mass airflow) MAP (manifold air pressure) to controller 12.

Exhaust passage 48 may receive exhaust gasses from cylinders 30. Exhaust gas sensor 128 is shown coupled to exhaust passage 48 upstream of turbine 62 and emission control device 78. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO, a NOx, HC, or CO sensor, for example. Emission control device 78 may be a three way catalyst (TWC), NOx trap, various other emission control devices, or combinations thereof.

Exhaust temperature may be measured by one or more temperature sensors (not shown) located in exhaust passage 48. Alternatively, exhaust temperature may be inferred based on engine operating conditions such as speed, load, AFR, spark retard, etc.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112, shown schematically in one location within the engine 10; a profile ignition pickup signal (PIP) from Hall effect sensor 118 (or other type) coupled to crankshaft 40; the throttle position (TP) from a throttle position sensor, as discussed; and absolute manifold pressure signal, MAP, from sensor 122, as discussed. Engine speed signal, RPM, may be generated by controller 12 from signal PIP. Manifold pressure signal MAP from a manifold pressure sensor may be used to provide an indication of vacuum, or pressure, in the intake manifold 44. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft 40. In some examples, storage medium read-only memory 106 may be programmed with computer readable data representing instructions executable by processor 102 for performing the methods described below as well as other variants that are anticipated but not specifically listed.

Engine 10 may further include a compression device such as a turbocharger or supercharger including at least a compressor 60 arranged along intake manifold 44. For a turbocharger, compressor 60 may be at least partially driven by a turbine 62, via, for example a shaft, or other coupling arrangement. The turbine 62 may be arranged along exhaust passage 48 and communicate with exhaust gasses flowing there-through. Various arrangements may be provided to drive the compressor. For a supercharger, compressor 60 may be at least partially driven by the engine and/or an electric machine, and may not include a turbine. Thus, the amount of compression provided to one or more cylinders of the engine via a turbocharger or supercharger may be varied by controller 12. In some cases, the turbine 62 may drive, for example, an electric generator 64, to provide power to a battery 66 via a turbo driver 68. Power from the battery 66 may then be used to drive the compressor 60 via a motor 70. Further, a sensor 123 may be disposed in intake manifold 44 for providing a BOOST signal to controller 12.

Turbocharging or supercharging of the internal combustion engine serves primarily for increasing power. The air required for the combustion process is compressed, as a result of which a greater air mass can be supplied to each cylinder per working cycle. In this way, the fuel mass and therefore the mean pressure can be increased. Supercharging is a suitable means for increasing the power of an internal combustion engine while maintaining an unchanged swept volume, or for reducing the swept volume while maintaining the same power. In any case, supercharging leads to an increase in volumetric power output and a more expedient power-to-weight ratio. If the swept volume is reduced, it is possible to shift the load collective toward higher loads, at which the specific fuel consumption is lower. By means of supercharging in combination with a suitable transmission configuration, it is also possible to realize so-called downspeeding, with which it is likewise possible to achieve a lower specific fuel consumption.

Supercharging consequently assists in the constant efforts in the development of internal combustion engines to minimize fuel consumption, that is to say to improve the efficiency of the internal combustion engine.

For supercharging, use is often made of an exhaust-gas turbocharger, in which a compressor and a turbine are arranged on the same shaft. The hot exhaust-gas flow is supplied to the turbine and expands in said turbine with a release of energy, as a result of which the shaft is set in rotation. The energy supplied by the exhaust-gas flow to the turbine and ultimately to the shaft is used for driving the compressor which is likewise arranged on the shaft. The compressor conveys and compresses the charge air fed to it, as a result of which supercharging of the cylinders is obtained. A charge-air cooling arrangement may additionally be provided, by means of which the compressed charge air is cooled before it enters the cylinders.

The advantage of an exhaust-gas turbocharger for example in comparison with a mechanical charger is that no mechanical connection for transmitting power exists or is required between the charger and internal combustion engine; such a mechanical connection takes up additional structural space in the engine bay and has a not inconsiderable influence on the arrangement of the assemblies. While a mechanical charger extracts the energy required for driving it entirely from the internal combustion engine, and thereby reduces the output power and consequently adversely affects the efficiency, the exhaust-gas turbocharger utilizes the exhaust-gas energy of the hot exhaust gases.

Problems are encountered in the configuration of the exhaust-gas turbocharging, wherein it is basically sought to obtain a noticeable performance increase in all engine speed ranges. In the case of internal combustion engines supercharged by way of an exhaust-gas turbocharger, a noticeable torque drop is observed when a certain engine speed is undershot. Said effect is undesirable and is one of the most severe disadvantages of exhaust-gas turbocharging.

Said torque drop is understandable if one takes into consideration that the charge pressure ratio is dependent on the turbine pressure ratio. For example, if the engine speed is reduced, this leads to a smaller exhaust-gas flow and therefore to a lower turbine pressure ratio. This has the effect that, toward lower rotational speeds, the charge pressure ratio likewise decreases, which equates to a torque drop.

A variety of measures may be used to improve the torque characteristic of an exhaust gas-turbocharged internal combustion engine.

One such measure, for example, is a small design of the turbine cross section and simultaneous provision of an exhaust-gas blow-off facility. Such a turbine is also referred to as a wastegate turbine. If the exhaust-gas mass flow exceeds a critical value, a part of the exhaust-gas flow is, within the course of a so-called exhaust-gas blow-off, conducted via a bypass line past the turbine. Said approach however has the disadvantage that the supercharging behavior is insufficient at relatively high engine speeds.

The torque characteristic of a supercharged internal combustion engine may furthermore be improved by means of multiple turbochargers arranged in parallel, that is to say by means of multiple turbines of relatively small turbine cross section arranged in parallel, turbines being activated successively with increasing exhaust-gas flow rate, similarly to sequential supercharging.

The torque characteristic may also be advantageously influenced by means of multiple exhaust-gas turbochargers connected in series. By connecting two exhaust-gas turbochargers in series, of which one exhaust-gas turbocharger serves as a high-pressure stage and one exhaust-gas turbocharger serves as a low-pressure stage, the compressor characteristic map can advantageously be expanded, specifically both in the direction of smaller compressor flows and also in the direction of larger compressor flows.

The torque characteristic of a supercharged internal combustion engine can also be improved through the use of at least one supercharger.

The advantage of a supercharger in relation to an exhaust-gas turbocharger consists in that the supercharger can generate, and make available, the required charge pressure at all times, specifically regardless of the operating state of the internal combustion engine. This applies in particular to a supercharger which can be driven electrically by means of an electric machine, and therefore independently of the rotational speed of the crankshaft.

Further advantageous embodiments of the direct-injection, supercharged internal combustion engine will be discussed below.

Returning to FIG. 1, exhaust passage 48 may include wastegate 26 for diverting exhaust gas away from turbine 62. In some embodiments, wastegate 26 may be a multi-staged wastegate, such as a two-staged wastegate with a first stage configured to control boost pressure and a second stage configured to increase heat flux to emission control device 78. Wastegate 26 may be operated with an actuator 150, which may be an electric actuator such as an electric motor, for example, though pneumatic actuators are also contemplated. Intake passage 42 may include a compressor bypass valve 27 configured to divert intake air around compressor 60. Wastegate 26 and/or compressor bypass valve 27 may be controlled by controller 12 via actuators (e.g., actuator 150) to be opened when a lower boost pressure is desired, for example.

Intake passage 42 may further include charge air cooler (CAC) 80 (e.g., an intercooler) to decrease the temperature of the turbocharged or supercharged intake gasses. In some embodiments, charge air cooler 80 may be an air to air heat exchanger. In other embodiments, charge air cooler 80 may be an air to liquid heat exchanger.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor (not shown) may be arranged within the EGR passage and may provide an indication of one or more of pressure, temperature, and concentration of the exhaust gas. Alternatively, the EGR may be controlled through a calculated value based on signals from the MAF sensor (upstream), MAP (intake manifold), MAT (manifold gas temperature) and the crank speed sensor. Further, the EGR may be controlled based on an exhaust $O_2$ sensor and/or an intake oxygen sensor (intake manifold). Under some conditions, the EGR system may be used to regulate the temperature of the air and fuel mixture within the combustion chamber. FIG. 1 shows a high pressure EGR system where EGR is routed from upstream of a turbine of a turbocharger to downstream of a compressor of a turbocharger. In other embodiments, the engine may additionally or alternatively include a low pressure EGR system where EGR is routed from downstream of a turbine of a turbocharger to upstream of a compressor of the turbocharger.

In some examples, engine 10 may be included in a propulsion system of a vehicle, such as a hybrid vehicle with multiple sources of torque available to one or more vehicle wheels. In other examples, the vehicle is a conventional vehicle with only an engine, or an electric vehicle with only electric machine(s). In the depicted example, the engine 10 may be included in a hybrid vehicle including an electric machine in addition to the engine. The electric machine may be a motor or a motor/generator. Crankshaft 40 of engine 10 and the electric machine may be connected via a transmission to vehicle wheels when one or more clutches are engaged. In one example, a first clutch may be provided between crankshaft 40 and the electric machine, and a second clutch may be provided between electric machine and transmission. Controller 12 may send a signal to an actuator of each clutch to engage or disengage the clutch, so as to connect or disconnect crankshaft 40 from the electric machine and the components connected thereto, and/or connect or disconnect electric machine from transmission and the components connected thereto. The transmission may be a gearbox, a planetary gear system, or another type of transmission. The powertrain may be configured in various manners including as a parallel, a series, or a series-parallel hybrid vehicle.

Electric machine may receive electrical power from a traction battery to provide torque to vehicle wheels. Electric machine may also be operated as a generator to provide electrical power to charge battery, for example during a braking operation.

FIG. 2 shows a direct injection engine system 200, which may be configured as a propulsion system for a vehicle. The engine system 200 includes an internal combustion engine 202 having multiple combustion chambers or cylinders 204. Engine 202 may be engine 10 of FIG. 1, for example. Fuel can be provided directly to the cylinders 204 via in-cylinder direct injectors 206. As indicated schematically in FIG. 2, the engine 202 can receive intake air and exhaust products of the combusted fuel. The engine 202 may include a suitable type of engine including a gasoline or diesel engine.

Fuel can be provided to the engine 202 via the injectors 206 by way of a fuel system indicated generally at 208. In this particular example, the fuel system 208 includes a fuel storage tank 210 for storing the fuel on-board the vehicle, a lower pressure fuel pump 212 (e.g., a fuel lift pump), a higher pressure fuel pump 214, an accumulator 215, a fuel rail 216, and various fuel passages 218 and 220. In the example shown in FIG. 2, the fuel passage 218 carries fuel from the lower pressure pump 212 to the higher pressure fuel pump 214, and the fuel passage 220 carries fuel from the higher pressure fuel pump 214 to the fuel rail 216.

The lower pressure fuel pump 212 can be operated by a controller 222 (e.g., controller 12 of FIG. 1) to provide fuel to higher pressure fuel pump 214 via fuel passage 218. The lower pressure fuel pump 212 can be configured as what may be referred to as a fuel lift pump. As one example, lower pressure fuel pump 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller 222 reduces the electrical power that is provided to pump 212, the volumetric flow rate and/or pressure increase across the pump may be reduced. The volumetric flow rate and/or pressure increase across the pump may be increased by increasing the electrical power that is provided to the pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, as indicated at 224, the flow rate and pressure of the fuel provided to higher pressure fuel pump 214 and ultimately to the fuel rail may be adjusted by the controller 222. In addition to providing injection pressure for direct injectors 206, pump 212 may provide injection pressure for one or more port fuel injectors (not shown in FIG. 2) in some implementations.

Low-pressure fuel pump 212 may be fluidly coupled to a filter 217, which may remove small impurities that may be contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar (g). An orifice check valve 221 may be placed in series with an orifice 223 to allow for air and/or fuel vapor to bleed out of the lift pump 212. In some embodiments, fuel system 208 may include one or more (e.g., a series) of check valves fluidly coupled to low-pressure fuel pump 212 to impede fuel from leaking back upstream of the valves. In this context, upstream flow refers to fuel flow traveling from fuel rail 216 towards low-pressure pump 212 while downstream flow refers to the nominal fuel flow direction from the low-pressure pump towards the fuel rail.

The higher pressure fuel pump 214 can be controlled by the controller 222 to provide fuel to the fuel rail 216 via the fuel passage 220. As one non-limiting example, higher pressure fuel pump 214 may utilize a flow control valve (e.g., fuel volume regulator, magnetic solenoid valve, solenoid spill valve, etc.) 226 to enable the control system to vary the effective pump volume of each pump stroke, as indicated at 227. However, it should be appreciated that other suitable higher pressure fuel pumps may be used. The higher pressure fuel pump 214 may be mechanically driven by the engine 202 in contrast to the motor driven lower pressure fuel pump 212. A pump piston 228 of the higher pressure fuel pump 214 can receive a mechanical input from the engine crank shaft or cam shaft via a cam 230. In this manner, higher pressure pump 214 can be operated according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222. In some examples, higher pressure fuel pump 214 may supply sufficiently high fuel pressure to injectors 206. As injectors 206 may be configured as direct fuel injectors, higher pressure fuel pump (HPP) 214 may be referred to as a direct injection (DI) fuel pump.

As elaborated herein with reference to FIGS. 3A-3B, HPP 214 may be configured as a piston pressure pump having a piston that is displaceable in transitional fashion between a top dead center and a bottom dead center and which comprises a pressure chamber of variable volume. An inlet side and outlet side of the HPP may be connectable to the pressure chamber, the displaceable piston jointly delimiting the pressure chamber with variable volume in such a way that a displacement of the piston causes a change in the volume $V_{chamber}$ of the pressure chamber.

FIG. 2 depicts the optional inclusion of accumulator 215, introduced above. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. The volume of accumulator 215 may be sized such that engine 202 can operate at idle conditions for a predetermined period of time between operating intervals of lower pressure fuel pump 212. For example, accumulator 215 can be sized such that when engine 202 idles, it takes one or more minutes to deplete pressure in the accumulator to a level at which higher pressure fuel pump 214 is incapable of maintaining a sufficiently high fuel pressure for fuel injectors 206. Accumulator 215 may thus enable an intermittent operation mode of lower pressure fuel pump 212 described below. In other embodiments, accumulator 215 may inherently exist in the compliance of fuel filter 217 and fuel line 218, and thus may not exist as a distinct element.

The controller 222 can individually actuate each of the injectors 206 via a fuel injection driver 236. The controller 222, the driver 236, and other suitable engine system controllers can comprise a control system. While the driver 236 is shown external to the controller 222, it should be appreciated that in other examples, the controller 222 can include the driver 236 or can be configured to provide the functionality of the driver 236. Controller 222 may include additional components not shown, such as those included in controller 12 of FIG. 1.

Fuel system 208 includes a low pressure (LP) fuel pressure sensor 231 positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to adjust the compression ratio of the HPP in a closed-loop manner. For example, LP fuel pressure sensor 231 may be used to determine whether fuel at the higher pressure fuel pump is in liquid fuel or fuel vapor, and to minimize the fuel vapor ingestion into the fuel rail, the compression ratio of the HPP piston pump may be increased. While LP fuel pressure sensor 231 is shown as being positioned upstream of accumulator 215, in other embodiments the LP sensor may be positioned downstream of the accumulator.

The fuel rail 216 includes a fuel rail pressure sensor 232 for providing an indication of fuel rail pressure to the controller 222. An engine speed sensor 234 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

Embodiments of the direct-injection, supercharged internal combustion engine=include the HPP having the variable compression ratio $\varepsilon_{pump}$, where the following applies: $\varepsilon_{pump}=(V_h+V_c)/V_c$, with $V_c$ denoting the volume $V_{chamber}$ of the pressure chamber when the piston of the HPP is situated at top dead center and $V_h$ denoting the swept volume passed through by the piston of the HPP between bottom dead center and top dead center.

In one example, HPP 214 includes only one movable actuation element, or only one movable actuation element is provided per high-pressure piston pump.

This embodiment states expressly that, in the present case, only a single actuation element is or must be provided. The costs are thereby reduced, and the controller or adjustment unit for varying the compression ratio of the high-pressure piston pump is simplified, because only a single actuation element has to be provided, installed and controlled or adjusted.

The actuation element according to the invention may, in terms of construction, be formed in a wide variety of ways.

For example, embodiments of the direct-injection, supercharged internal combustion engine are advantageous in which the at least one movable actuation element of the HPP is an actuation piston that is displaceable in translational fashion. Here, the actuation piston is displaceable, preferably in continuously variable fashion, along an axis, for example its longitudinal axis. The actuation piston may be of cylindrical or oval form in cross section.

In this context, embodiments of the direct-injection, supercharged internal combustion engine are advantageous in which the actuation piston projects into the pressure chamber.

Embodiments of the direct-injection, supercharged internal combustion engine may also be advantageous in which the at least one movable actuation element is a rotatable actuation disk.

The actuation disk may have a diameter which varies in a circumferential direction, wherein, by rotating the disk about an axis of rotation, a greater or lesser diameter of the disk projects into the pressure chamber, giving rise to a variation of the compression ratio.

The actuation disk may also have a thickness which varies in a circumferential direction, wherein, by rotating the disk about the axis of rotation, a disk of greater or lesser thickness projects into the pressure chamber, in turn giving rise to a variation of the compression ratio.

Alternatively or in addition, the actuation disk may have apertures or recesses of different sizes distributed over the circumference. Apertures or recesses of different sizes which project into the pressure chamber may serve for the setting of different compression ratios.

Embodiments of the direct-injection, supercharged internal combustion engine may likewise be advantageous in which the at least one movable actuation element is a rotatable actuation drum.

That which has been stated for the actuation disk applies analogously to the actuation drum, wherein an actuation drum inherently has a greater extent in a longitudinal direction, that is to say in the direction of the axis of rotation, than an actuation disk.

The actuation drum may have a diameter which varies in a circumferential direction, wherein, by rotating the drum about an axis of rotation, a greater or lesser diameter of the drum projects into the pressure chamber, giving rise to a variation of the compression ratio.

The actuation drum may also have a thickness, that is to say an extent in the longitudinal direction, which varies in a circumferential direction, wherein, by rotating the drum about the axis of rotation, a drum of greater or lesser thickness projects into the pressure chamber, in turn giving rise to a variation of the compression ratio.

Alternatively or in addition, the actuation drum may have apertures or recesses of different sizes distributed over the circumference. Apertures or recesses of different sizes which project into the pressure chamber may serve for the setting of different compression ratios.

Embodiments of the direct-injection, supercharged internal combustion engine are advantageous in which a check valve is provided on the inlet side.

A check valve arranged on the inlet side duly allows fuel to be drawn in during the course of a suction stroke of the pump, but prevents fuel from being delivered or returned to the inlet side during the delivery stroke of the pump.

Embodiments of the direct-injection, supercharged internal combustion engine are advantageous in which a check valve is provided on the outlet side.

A check valve arranged on the outlet side prevents a backflow of fuel that has already been delivered to the outlet side back into the high-pressure pump, in particular during the suction stroke of the pump.

Embodiments of the direct-injection, supercharged internal combustion engine are advantageous in which the low-pressure side is at least connectable to a container for storing fuel.

Embodiments of the direct-injection, supercharged internal combustion engine are advantageous in which the piston which is displaceable in translational fashion is not the at least one movable actuation element or a movable actuation element. This embodiment expressly excludes variants in which the piston which is displaceable in translational fashion is equipped with a variable crank drive, for example with a variable-length connecting rod or piston rod by means of which it would basically also be possible for the compression ratio of the pump to be varied, similarly to an internal combustion engine in which the compression ratio of a cylinder can be varied by means of the length of the connecting rod.

The adjustment device for the at least one movable actuation element may be electromagnetically, mechanically, hydraulically or else pneumatically operated.

The adjustment device introduces an external force into the actuation element in order to move the actuation element, for example in order to displace an actuation piston along a displacement axis or rotate an actuation disk or actuation drum about an axis of rotation.

The second sub-object on which the invention is based, specifically that of specifying a method for operating a direct-injection, supercharged internal combustion engine of a type described above, in which the at least one movable actuation element is at least one actuation piston which is displaceable in translational fashion and which projects into the pressure chamber, is achieved by means of a method which is distinguished by the fact that at least one actuation piston is displaced in order to vary the compression ratio $\varepsilon_{pump}$ of the high-pressure piston pump.

That which has already been stated with regard to the internal combustion engine according to the invention also applies to the method according to the invention, for which reason reference is generally made at this juncture to the statements made above with regard to the internal combustion engine. The different internal combustion engines require, in part, different method variants.

Method variants are advantageous in which at least one actuation piston is displaced into the pressure chamber in order to increase the compression ratio $\varepsilon_{pump}$ of the high-pressure piston pump.

In this context, method variants are also advantageous in which at least one actuation piston is pulled out of the pressure chamber in order to decrease the compression ratio $\varepsilon_{pump}$ of the high-pressure piston pump.

Method variants are advantageous in which at least one actuation piston is displaced into the pressure chamber in order to counteract an evaporation of fuel. In the present case, the compression ratio $\varepsilon_{pump}$ of the high-pressure piston pump is increased in preventative fashion. The increased compression ratio ensures a higher pressure level, in the presence of which the risk of evaporation of fuel is lower.

Method variants may also be advantageous in which, proceeding from a state in which at least partially evaporated fuel is present in the pressure chamber, at least one actuation piston is displaced into the pressure chamber in order to liquefy the evaporated fuel. In the present case, the compression ratio $\varepsilon_{pump}$ of the high-pressure piston pump is increased in order to re-liquefy fuel that has already evaporated.

The invention will be discussed in more detail below on the basis of an exemplary embodiment and according to FIGS. 3A-3B.

FIG. 3A schematically shows, in a diagrammatic sketch, a fragment of the fuel supply system 1 of a first embodiment of the internal combustion engine with the high-pressure piston pump 3 and a relatively high compression ratio $\varepsilon_{pump,high}$.

The illustrated fuel supply system 1 serves for the supply of fuel to the cylinders of the internal combustion engine. A high-pressure piston pump 3 (which in one example includes HPP 214 of FIG. 2) is provided for the purposes of delivering fuel. The high-pressure piston pump 3 has a pressure chamber 3*a*, which is variable in volume and which serves as a working chamber, and a piston 3*b*, which jointly delimits the pressure chamber 3*a* and which is displaceable in translational fashion between a bottom dead center and a top dead center. The pressure chamber 3*a* is connectable to an inlet side 2*a* and to an outlet side 2*b* of the high-pressure piston pump 3.

A displacement of the piston 3*b* results in a change in the volume $V_{chamber}$ of the pressure chamber 3*a*. During the operation of the pump 3, the piston 3*b* which is displaceable in translational fashion oscillates and delivers fuel. Here, during the course of a suction stroke, fuel is drawn in from the inlet side 2*a* and, during the course of a delivery stroke, is pumped to the outlet side 2*b*. On the inlet side 2*a*, there is arranged a check valve 5*a* for preventing a delivery of fuel to the inlet side 2*a* during the delivery stroke of the pump 3. On the outlet side 2*b* there is arranged a check valve 5*b* for preventing fuel that has already been delivered to the outlet side 2*b* from flowing back into the pump 3.

The high-pressure piston pump 3 is equipped with a movable actuation element 4 which likewise jointly delimits the pressure chamber 3*a*. In the embodiment illustrated in FIG. 3A, an actuation piston 4*a* which is displaceable in translational fashion and which projects into the pressure chamber 3*a* serves as actuation element 4.

A displacement of the actuation piston 4*a* results in a change in the volume $V_{chamber}$ of the pressure chamber 3*a* and thereby permits an adjustment or a variation of the compression ratio $\varepsilon_{pump}$ of the high-pressure piston pump 3.

In the position illustrated in FIG. 3A, the actuation piston 4*a* projects into the pressure chamber 3*a*, that is to say the actuation piston 4*a* has been displaced into the pressure chamber 3*a* such that the high-pressure piston pump 3 has a high or relatively high compression ratio $\varepsilon_{pump,high}$.

FIG. 3B shows the high-pressure piston pump 3 illustrated in FIG. 3A, but with a relatively low compression ratio $\varepsilon_{pump,low}<\varepsilon_{pump,high}$. The actuation piston 4*a* has been pulled out of the pressure chamber 3*a* in order to decrease the compression ratio $\varepsilon_{pump}$ of the high-pressure piston pump 3. In FIG. 3B, the actuation piston 4*a* is no longer projecting into the pressure chamber 3*a*.

As used herein, $V_{chamber}$ refers to the Volume of the pressure chamber; $v_c$ refers to the compression volume, or volume of the pressure chamber when the piston is situated at top dead center; $V_h$ refers to the swept volume of the piston of the high-pressure piston pump; $\varepsilon_{pump,high}$ refers to the High compression ratio; $\varepsilon_{pump,low}$ refers to the Low compression ratio; and $\varepsilon_{pump}$ refers to the variable compression ratio of the high-pressure piston pump.

FIGS. 1-2 and 3A-3B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 4:
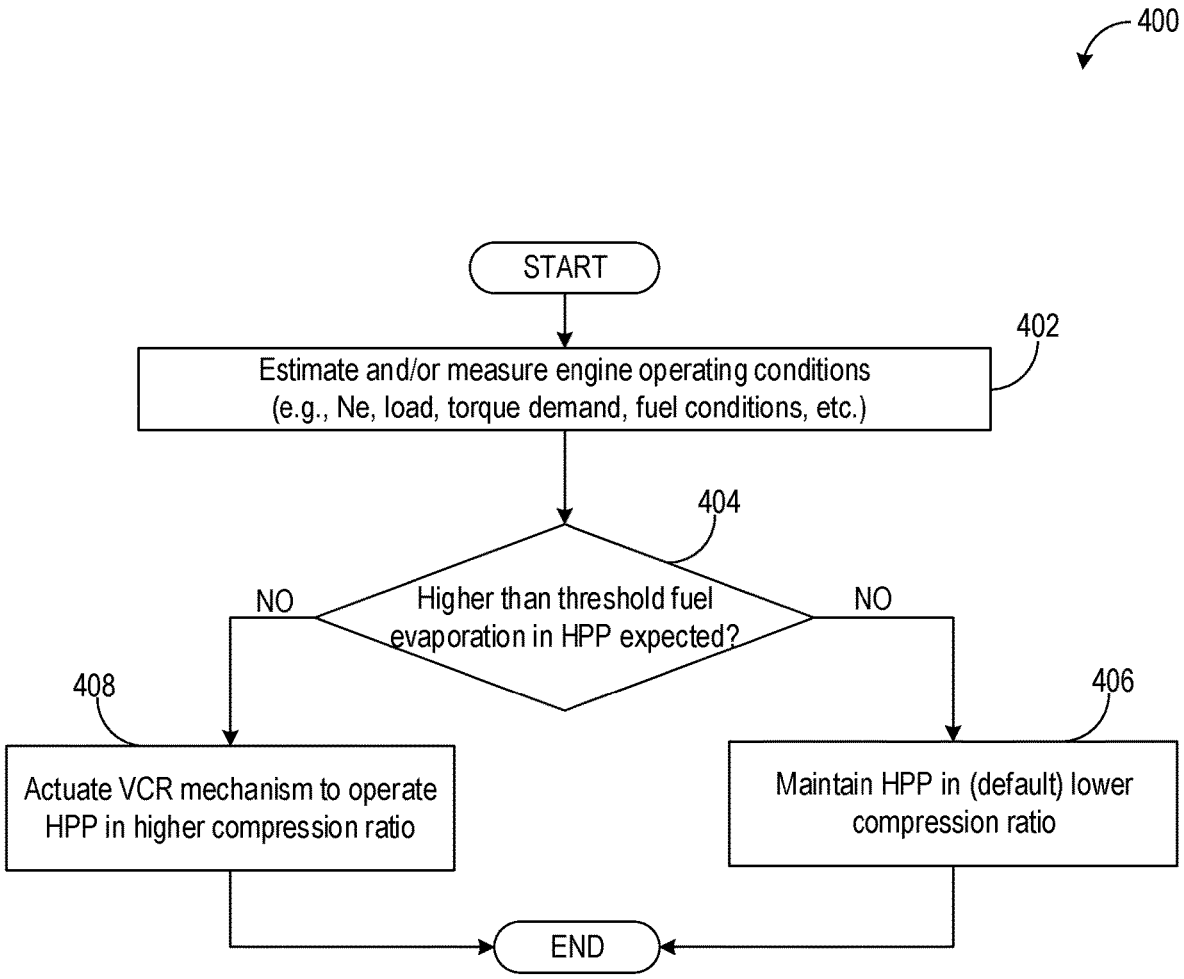
FIG. 4 shows a flowchart illustrating an example routine for adjusting a compression ratio of a high pressure fuel pump to reduce fuel evaporation.

Turning now to FIG. 4, an example method 400 is shown for adjusting the compression ratio of the high pressure piston pump coupled to the direct injection system. Instructions for carrying out method 400 may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 402, the method includes estimating and/or measuring engine operating conditions. These may include, for example, driver demand, engine speed and load, boost pressure, EGR level, engine dilution, manifold air pressure, manifold air flow, ambient conditions such as ambient temperature, pressure, and humidity, and fuel conditions. In one example, fuel conditions assessed may include fuel temperature and fuel pressure. For example, a fuel rail temperature sensor may be used to infer the temperature of fuel being received at the high pressure pump of the direct injection fuel system. As another example, a fuel rail pressure sensor, or a pressure sensor coupled to an outlet of the lift pump, may be used to infer the pressure of fuel being received at the high pressure pump of the direct injection fuel system. In still other examples, fuel temperature and pressure may be inferred based on estimated engine operating conditions such as engine speed and load, engine temperature, ambient conditions, and duration of engine operation.

Based at least on the inferred fuel temperature and pressure, the amount or fraction of the fuel being pumped by the high pressure piston pump that is in the fuel vapor state relative to the liquid fuel state may be inferred. At 404, it may be determined if higher than threshold fuel evaporation is expected at the HPP. In one example, a higher than threshold fuel evaporation may be determined if the vapor fraction of the fuel at the HPP is higher than the liquid fuel fraction at the HPP. For example, a higher fuel vapor fraction may be inferred when the fuel temperature is higher than a threshold temperature. As another example, a higher fuel vapor fraction may be inferred when the fuel pressure is higher than a threshold pressure. As yet another example, a higher fuel vapor fraction may be inferred when the ambient temperature is higher than a threshold temperature, or the ambient/barometric pressure is lower than a threshold pressure (such as at higher altitudes). As yet another example, a higher than threshold fuel evaporation may be expected during hot engine starts.

If higher than threshold fuel evaporation at the HPP is not detected, anticipated, or predicted, at 406, the method includes continuing to operate the HPP (to direct inject fuel into the engine) with the piston of the HPP in the lower compression ratio setting. This includes maintaining the variable compression ratio mechanism of the HPP at the default position where the displacement volume between TDC and BDC of the piston is lower.

Else, if higher than threshold fuel evaporation at the HPP is detected, anticipated, or predicted, at 408, the method includes transitioning to operating the HPP (to direct inject fuel into the engine) with the piston of the HPP in the higher compression ratio setting. This includes actuating the variable compression ratio mechanism of the HPP from the default position to a position where the displacement volume between TDC and BDC of the piston is higher. By increasing the compression ratio of the piston of the HPP, a larger portion of the fuel vapors at the HPP (e.g., substantially all the fuel vapors at the HPP) are converted to liquid fuel. In other words, fuel that has already evaporated in the chamber of the HPP is liquefied to liquid fuel.

As one example, during an engine cold-start, the engine is fueled via direct injection with the HPP operating at the lower compression ratio. In comparison, during an engine hot-start, the engine is fueled via direct injection with the HPP operating at the higher compression ratio. As another example, during engine operation at a lower altitude, the engine is fueled via direct injection with the HPP operating at the lower compression ratio. In comparison, during engine operation at a higher altitude, the engine is fueled via direct injection with the HPP operating at the higher compression ratio. As yet another example, during engine operation at a lower ambient temperature, the engine is fueled via direct injection with the HPP operating at the lower compression ratio. In comparison, during engine operation at a higher ambient temperature, the engine is fueled via direct injection with the HPP operating at the higher compression ratio. As yet another example, during engine operation with a fuel having a lower alcohol content, the engine is fueled via direct injection with the HPP operating at the lower compression ratio. In comparison, during engine operation with a fuel having a higher alcohol content, the engine is fueled via direct injection with the HPP operating at the higher compression ratio. As still a further example, during a limp-home mode, where one or more sensors of the engine system are degraded, the engine may be operated with the HPP in the lower compression ratio, and further may be maintained in the lower compression ratio even if fuel vapor conditions are present. Else, if all the sensors are functional, the engine may be operated with the HPP in the higher compression ratio when required.

In some embodiments, an inlet metering valve may be coupled to the HPP, upstream of an inlet of the HPP. An opening of the metering valve may be adjusted based on the compression ratio of the HPP. For example, the compression ratio may be adjusted based on a fuel rail pressure of a DI fuel rail coupled downstream of the HPP, and an opening of the metering valve may also be adjusted based on the fuel rail pressure. In one example, the inlet metering valve is a solenoid spill valve, such as valve 226 of FIG. 2, which may be electronically energized to close and de-energized to open (or vice versa). Depending on when the spill valve is energized during operation of the DI high pressure piston pump, an amount of fuel may be trapped and compressed by the DI pump during a delivery stroke, wherein the amount of fuel may be referred to as fractional trapping volume if expressed as a fraction or decimal, fuel volume displacement, or pumped fuel mass, among other terms. This is the volume of fuel trapped inside the HPP. A controller may use the solenoid actuated "spill valve" (SV) to enable the effective pump volume of each pump stroke of the HPP to be varied. SV may be separate or part of (i.e., integrally formed with) the HPP.

The direct injection or high-pressure piston pump may be controlled to compress a fraction of their full displacement by varying closing timing of the solenoid spill valve. As such, a full range of pumping volume fractions may be provided to the direct injection fuel rail and direct injectors depending on when the spill valve is energized and de-energized.

In one example, if the fuel rail pressure of the DI fuel rail drops below a threshold pressure (e.g., a target pressure) due to fuel vapor formation in the pressure chamber of the HPP, the controller may adjust the inlet metering valve to stay closed longer during the compression stroke to build more pressure per pump stroke. For example, the metering valve may be held in the closed position until compression stroke TDC is reached. In one example, the trapping volume fraction may be 100% when the solenoid spill valve is energized to a closed position coincident with the beginning of a compression stroke of the piston of the direct injection fuel pump. In another example, the metering valve adjustments may be coordinated with the compression ratio adjustments to enhance HPP performance. For example, responsive to fuel vapor formation, the controller may increase the compression ratio while also holding the metering valve closed longer so as to increase the pressure per pump stroke, to enhance the liquefaction of fuel vapor to liquid fuel at the HPP.

In this way, by adjusting the compression ratio of a piston of a high pressure piston pump coupled to a direct injection fuel system, fuel vapors may be liquefied in the chamber of the HPP. By converting the fuel vapors to liquid fuel in the piston chamber of the HPP, issues relating to ingestion of fuel vapor at the pump, such as fuel metering errors and resulting torque errors, can be reduced. In addition, emissions quality may be improved. Overall, direct injected engine performance may be improved.

One example method comprises: adjusting the compression ratio of a high pressure piston pump of a direct injection fuel system responsive to a fuel rail pressure of a downstream direct injection fuel rail. In the preceding example, additionally or optionally, adjusting the compression ratio includes actuating a displaceable element coupled to a piston of the high pressure piston pump to change a volume of a pressure chamber of the high pressure piston pump, the displaceable element including one of a rotatable actuation drum, a rotatable actuation disk, and a translationally actuatable piston. In any or all of the preceding examples, additionally or optionally, the adjusting includes increasing the compression ratio by actuating the displaceable element into the pressure chamber responsive to lower than threshold fuel rail pressure, and decreasing the compression ratio by actuating the displaceable element out of the pressure chamber responsive to higher than threshold fuel rail pressure. In any or all of the preceding examples, additionally or optionally, the method further comprises further adjusting the compression ratio responsive to determined fuel vapor formation at the high pressure piston pump, the adjusting including increasing the compression ratio responsive to the determined fuel vapor formation. In any or all of the preceding examples, additionally or optionally, the high pressure piston pump receives fuel from a fuel tank via a lift pump, the method further comprising, determining fuel vapor formation at the high pressure piston pump responsive to output from a pressure sensor coupled in a fuel line downstream of the lift pump and upstream of the high pressure piston pump. In any or all of the preceding examples, additionally or optionally, the method further comprises determining fuel vapor formation at the high pressure piston pump responsive to one or more of a higher than threshold fuel temperature, higher than threshold fuel pressure, higher than threshold barometric pressure, and an engine hot-start condition. In any or all of the preceding examples, additionally or optionally, the fuel line further includes an inlet metering valve coupled upstream of the high pressure piston pump, the method further comprising adjusting an opening of the inlet metering valve based on the fuel rail pressure of the direct injection fuel rail.

Another example method for an engine comprises: direct injecting fuel pressurized by a high pressure piston pump into an engine cylinder; and adjusting a compression ratio of the pump by actuating a variable compression ratio mechanism responsive to fuel vapor formation in a pressure chamber of the high pressure piston pump. In the preceding example, additionally or optionally, the adjusting responsive to fuel vapor formation includes increasing the compression ratio responsive to a higher than threshold fuel vapor content in the pressure chamber of the high pressure piston pump by displacing the variable compression ratio mechanism into the pressure chamber, the variable compression ratio mechanism including one of a rotatable actuation drum, a rotatable actuation disk, and a translationally actuatable piston. In any or all of the preceding examples, additionally or optionally, increasing the compression ratio includes liquefying the higher than threshold fuel vapor content of the chamber into liquid fuel, the method further comprising determining fuel vapor formation in the pressure chamber including the higher than threshold fuel vapor content in the chamber of the high pressure piston pump responsive to one of more of a higher than threshold fuel temperature, higher than threshold fuel pressure, higher than threshold barometric pressure, and an engine hot-start condition, the fuel vapor content in the chamber of the high pressure piston pump estimated based on an output of a lift pump supplying fuel from a fuel tank to the high pressure piston pump. In any or all of the preceding examples, additionally or optionally, the compression ratio of the pump is further adjusted responsive to a fuel rail pressure of a direct injection fuel rail coupled downstream of the high pressure piston pump. In any or all of the preceding examples, additionally or optionally, the method further comprises adjusting an opening of an inlet metering valve coupled to an inlet of the high pressure piston pump based on the fuel rail pressure.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

adjusting a compression ratio of a pressure chamber above a piston of a high pressure piston pump of a direct injection fuel system via a translationally actuatable piston responsive to a fuel rail pressure of a downstream direct injection fuel rail, the chamber and the translationally actuatable piston positioned downstream of an outlet of an inlet check valve and upstream of an inlet of an outlet check valve, the adjusting including adjusting the compression ratio responsive to determined fuel vapor formation at the high pressure piston pump, the adjusting including increasing the compression ratio responsive to the determined fuel vapor formation.

2. The method of claim 1, wherein adjusting the compression ratio includes actuating a displaceable element coupled directly to the pressure chamber to change a volume of the pressure chamber of the high pressure piston pump, the displaceable element including the translationally actuatable piston that moves along a common axis with motion of the piston of the high pressure piston pump.

3. The method of claim 2, wherein the adjusting includes increasing the compression ratio by actuating the displaceable element into the pressure chamber responsive to lower than threshold fuel rail pressure, and decreasing the compression ratio by actuating the displaceable element out of the pressure chamber responsive to higher than threshold fuel rail pressure.

4. The method of claim 2, wherein the high pressure piston pump receives fuel from a fuel tank via a lift pump, the method further comprising determining fuel vapor formation at the high pressure piston pump responsive to output from a pressure sensor coupled in a fuel line downstream of the lift pump and upstream of the high pressure piston pump.

5. The method of claim 2, further comprising determining fuel vapor formation at the high pressure piston pump responsive to one or more of a higher than threshold fuel temperature, a higher than threshold fuel pressure, a higher than threshold barometric pressure, and an engine hot-start condition.

6. The method of claim 4, wherein the fuel line further includes an inlet metering valve coupled upstream of the high pressure piston pump, the method further comprising adjusting an opening of the inlet metering valve based on the fuel rail pressure of the direct injection fuel rail.

7. A method for an engine, comprising:

direct injecting fuel pressurized by a high pressure piston pump into an engine cylinder; and adjusting a compression ratio of a pressure chamber above a piston of the high pressure piston pump by actuating a variable compression ratio mechanism including via a translationally actuatable piston responsive to fuel vapor formation in a pressure chamber of the high pressure piston pump, the translationally actuatable piston positioned downstream of an outlet of an inlet check valve and upstream of an inlet of an outlet check valve, the translationally actuatable piston moving along a common axis with the piston.

8. The method of claim 7, wherein the adjusting responsive to fuel vapor formation includes increasing the compression ratio responsive to a higher than threshold fuel vapor content in the pressure chamber of the high pressure piston pump by displacing the variable compression ratio mechanism into the pressure chamber, the variable compression ratio mechanism including one of a rotatable actuation drum, a rotatable actuation disk, and the translationally actuatable piston.

9. The method of claim 8, wherein increasing the compression ratio includes liquefying the higher than threshold fuel vapor content of the pressure chamber into liquid fuel, the method further comprising determining fuel vapor formation in the pressure chamber including the higher than threshold fuel vapor content in the pressure chamber of the high pressure piston pump responsive to one of more of a higher than threshold fuel temperature, a higher than threshold fuel pressure, a higher than threshold barometric pressure, and an engine hot-start condition, the fuel vapor content in the pressure chamber of the high pressure piston pump estimated based on an output of a lift pump supplying fuel from a fuel tank to the high pressure piston pump.

10. The method of claim 7, wherein the compression ratio of the high pressure piston pump is further adjusted responsive to a fuel rail pressure of a direct injection fuel rail coupled downstream of the high pressure piston pump.

11. The method of claim 10, further comprising adjusting an opening of an inlet metering valve coupled to an inlet of the high pressure piston pump based on the fuel rail pressure.

* * * * *